US007540712B1

(12) United States Patent
Liang

(10) Patent No.: US 7,540,712 B1
(45) Date of Patent: Jun. 2, 2009

(54) TURBINE AIRFOIL WITH SHOWERHEAD COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 377 days.

(21) Appl. No.: 11/521,747

(22) Filed: Sep. 15, 2006

(51) Int. Cl.
*F01D 5/18* (2006.01)

(52) U.S. Cl. ..... 416/1; 416/97 R

(58) Field of Classification Search ..... 415/1, 415/115, 116; 416/1, 96 R, 96 A, 97 R, 97 A
See application file for complete search history.

(56) References Cited

U.S. PATENT DOCUMENTS 4,180,373 A 12/1979 Moore et al.
4,257,737 A * 3/1981 Andress et al. ..... 416/97 R
4,314,442 A * 2/1982 Rice ..... 415/115
4,456,428 A 6/1984 Cuvillier
4,474,532 A 10/1984 Pazder
5,387,086 A 2/1995 Frey et al.
5,700,131 A * 12/1997 Hall et al. ..... 416/97 R
5,967,752 A 10/1999 Lee et al.
6,050,777 A * 4/2000 Tabbita et al. ..... 416/97 R
6,139,269 A 10/2000 Liang
6,273,682 B1 8/2001 Lee
6,287,075 B1 9/2001 Kercher
6,491,496 B2 12/2002 Starkweather
7,246,992 B2 * 7/2007 Lee ..... 415/115

FOREIGN PATENT DOCUMENTS

GB 2127105 A * 4/1984 ..... 416/97 R
GB 2402715 A * 12/2004 ..... 416/97 R

* cited by examiner

*Primary Examiner*—Christopher Verdier
(74) *Attorney, Agent, or Firm*—John Ryznic

(57) ABSTRACT

A showerhead cooling arrangement for a turbine airfoil in which the showerhead includes a plurality of rows of diffusion slots arranged in an inverted V across a stagnation point of the airfoil. At least two diffusion slots are spaced along the suction side and at least two of the diffusion slots are spaced along the pressure side of the airfoil. Each diffusion slot has a rectangular cross section shape with a width about two times the height. Each diffusion slot includes a metering hole to meter cooling air from the cooling supply cavity. Each row of diffusion slots opens into a continuous diffusion slot to further diffuse the cooling air before discharging onto the leading edge. Cooling air follows a path through a metering hole, then a first diffusion into the individual diffusion slots, and then a second diffusion into the continuous diffusion slot.

12 Claims, 2 Drawing Sheets

TURBINE AIRFOIL WITH SHOWERHEAD COOLING HOLES

BACKGROUND OF THE INVENTION

1. Field of the Invention

The present invention relates generally to fluid reaction surfaces, and more specifically to a showerhead arrangement for a turbine airfoil.

2. Description of the Related Art Including Information Disclosed Under 37 CFR 1.97 and 1.98

A gas turbine engine includes a turbine section with a plurality of stages of stationary vanes and rotary blades to extract mechanical energy from a hot gas flow passing through the turbine. The gas turbine engine efficiency can be increased by providing for a higher temperature of the gas flow entering the turbine. The temperature entering the turbine is limited to the first stage vane and rotor blades ability to withstand the high temperature.

One method of allowing for higher temperatures than the material properties of the first stage vane and blades would allow is to provide for cooling air passages through the airfoils. Since the cooling air used to cool the airfoils is generally bled off from the compressor, it is also desirable to use a minimum amount of bleed off air in order to improve the efficiency of the engine. The compressor performs work on the compressed air to compress the bleed air for use in cooling the airfoils, and this work is wasted.

The hottest part of the airfoils is found on the leading edge. Complex designs have been proposed to provide the maximum amount of cooling for the leading edge while using the minimum amount of cooling air. One leading edge airfoil design is the showerhead arrangement. In the Prior Art, a blade leading edge showerhead comprises three rows of cooling holes as shown in FIG. 1. The showerhead arrangement 10 of the Prior Art includes a cooling air supply channel 11, a metering hole 13, a showerhead cavity 12, and a plurality of film cooling holes 14. The middle film row is positioned at the airfoil stagnation point which is where the highest heat load is found on the airfoil leading edge. The cooling hole labeled as 14 is FIG. 1 with the arrow indicating the cooling air flow is the stagnation point. Film cooling holes for each row are at an inline pattern and at a staggered array relative to the adjacent film row as seen in FIG. 3. The showerhead cooling holes 14 are inclined at 20 to 35 degrees relative to the blade leading edge radial surface as shown in FIG. 2.

The Prior Art showerhead arrangement of FIGS. 1-3 suffers from the following problems. The heat load onto the blade leading edge region is in parallel to the film cooling hole array, and therefore reduces the cooling effectiveness. The portion of the film cooling holes within each film row is positioned behind each other as shown in FIG. 2 that reduces the effective frontal convective area and conduction distance for the oncoming heat load. Realistic minimum film hole spacing to diameter ratio is approximately at 3.0. Below this ratio, zipper effect cracking may occur for the film row. This translates to maximum achievable film coverage for that particular film row to be 33% or 0.33 film effectiveness for each showerhead film row. Since the showerhead film holes are at radial orientation, film pattern discharge from the film hole is overlapped to each other. Little or no film is evident in-between film holes.

It is therefore an object of the present invention to provide for an improved showerhead arrangement for a turbine airfoil that will use less cooling air than the Prior Art arrangement and produce more cooling of the leading edge.

BRIEF SUMMARY OF THE INVENTION

A showerhead cooling hole arrangement for a turbine airfoil leading edge. A plurality of multi-metering and multi-diffusion slots is positioned on the leading edge for cooling. Each row of cooling holes includes four diffusion slots on the leading edge, two slots on a pressure side of the stagnation point and two slots on the suction side of the stagnation point. The row of slots is angled downward in an inverted V arrangement. Each diffusion slot is supplied with cooling air from a metering hole connected to the cooling supply cavity. A continuous diffusion slot extends across the four separate diffusion slots. The multi-metering and diffusion cooling slots utilizes multiple 2-dimensional shaped diffusion cooling hole for backside convective cooling as well as flow metering purposes. The amount of cooling air for each individual 2-dimensional shape diffusion cooling hole is sized based on the local gas side heat load and pressure in order to regulate the local cooling performance and metal temperature. The cooling air is metered by each individual 2-dimensional shape diffusion cooling hole that allows the cooling air to diffuse uniformly into a continuous film cooling slot which reduces the cooling air exit momentum. Coolant penetration into the gas path is minimized, yielding a good build-up of the coolant sub-boundary layer next to the leading edge surface, providing for better film coverage in the spanwise and chordwise directions for the airfoil leading edge. The showerhead arrangement of the present invention maximizes the usage of cooling air for a given airfoil inlet gas temperature and pressure profile. The combination effects of the multi-metering plus multi-diffusion slot film cooling at high film coverage yields a very high cooling effectiveness and uniform wall temperature for the airfoil leading edge region.

DETAILED DESCRIPTION OF THE INVENTION

Figure 4:
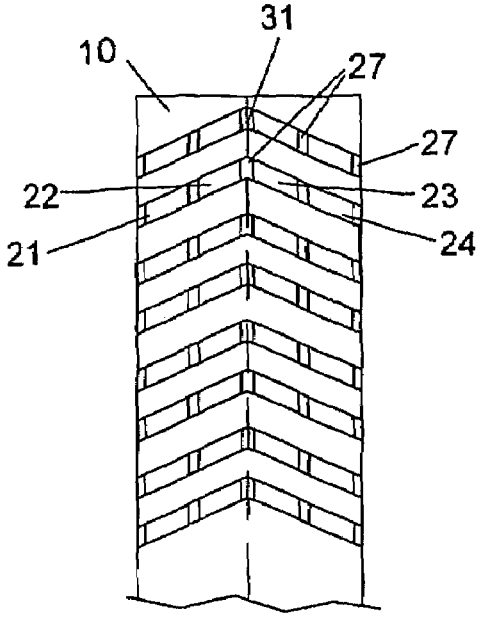
FIG. 4 shows a front view of the showerhead cooling arrangement of the present invention.
Figure 5:
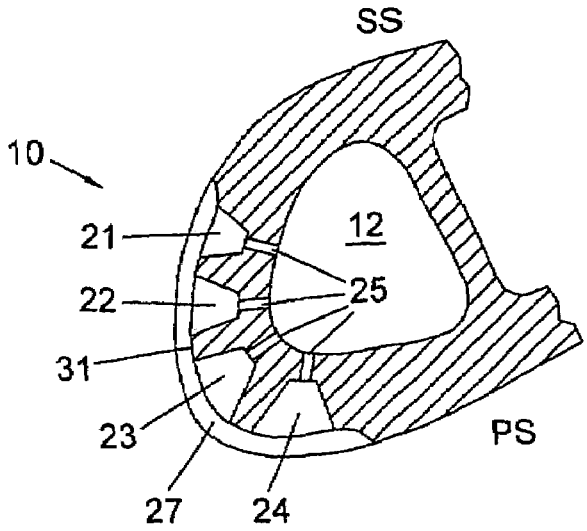
FIG. 5 shows a cross section view of the leading edge showerhead cooling holes of the present invention.

The present invention is a showerhead cooling hole arrangement for a leading edge airfoil used in a gas turbine engine. FIGS. 4 and 5 show the present invention. FIG. 5 shows the showerhead 10 on the leading edge of a stationary vane or rotary blade to include the cooling supply channel 12, and four diffusion slots 21-24 each supplied with cooling air from supply holes 25 connected to the cooling supply channel 12. Two 2-dimensional diffusion slots 21 and 22 are located on the suction side of the stagnation point 31. Another two 2-dimensional diffusion slots 23 and 24 are located on the pressure side of the stagnation point 31. The supply holes 25 are multi-metering holes to meter cooling air flow into the respective diffusion slot. A continuous diffusion slot 27 extends from the first 2-dimensional diffusion slot 21 and around the leading edge of the airfoil to the fourth 2-dimensional diffusion slot 24. As seen in FIG. 5, the continuous diffusion slot 27 extends just past the last 2-dimensional diffusion slot.

Figure 1:
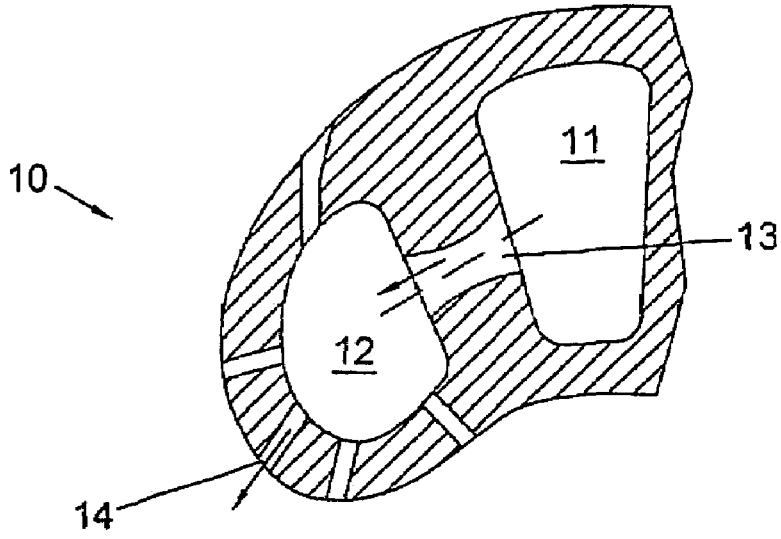
Fig 1 Prior Art
FIG. 1 shows a prior art showerhead cooling arrangement for a turbine airfoil.
Figure 2:
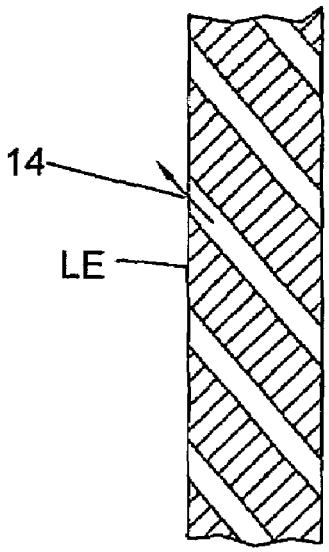
Fig 2 Prior Art
FIG. 2 shows a cross section view of the leading, edge cooling holes for the prior art FIG. 1 showerhead.
Figure 3:
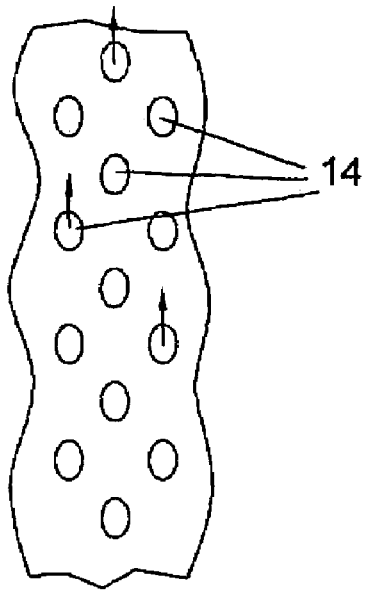
Fig 3 Prior Art
FIG. 3 shows a front view of the leading edge showerhead arrangement of the FIG. 1 prior art turbine airfoil.

FIG. 4 shows a front view of the showerhead cooling holes of the present invention. Each row of showerhead film cooling holes is arranged in an inverted V-shape orientation. The showerhead 10 includes a plurality of rows of four 2-dimensional diffusion slots 21-24 located within the continuous diffusion slot 27. The stagnation point 31 is shown between the suction side slots 21 and 22 and the pressure side slots 23 and 24. The 2-dimensional slots 21-24 are angled at about 20 to about 35 degrees from the radial direction of the leading edge as in the prior art FIG. 2 design. The film cooling holes 25 are angled at about 25 to about 35 degrees, and the individual or first diffusion slots 21-24 and the continuous or second diffusion slot are all angled at from 20 to 35 degrees. The slots are substantially rectangular in cross sectional shape when looking at them from the front of the leading edge in that the slots can vary slightly from a rectangular shape since slight variations in the side walls of the slot from a straight edge will not vary the diffusion effect of the slot. The first diffusion slots 21-24 have substantially the same height in the blade spanwise direction as the second or continuous diffusion slot 27.

Cooling air supplied to the cooling supply cavity 12 is metered through the multi-metering holes 25 and into the respective 2-dimensional diffusion slots 21 through 24. The multi-metering holes 25 are individually sized to provide the desired amount of cooling for the particular location on the airfoil leading edge. The cooling air from the 2-dimensional diffusion slots 21-24 then passes into the continuous diffusion slot 27 and is uniformly diffused to reduce the cooling air exit momentum.

The multi-metering and multi-diffusion showerhead film slot cooling arrangement of the present invention increases the blade leading edge film effectiveness to the level above the cited prior art designs and improves the overall convection capability which reduces the blade leading edge metal temperature. The showerhead arrangement of the present invention can be used in stationary vanes or rotary blades, both vanes and blades being considered airfoils in a gas turbine engine. In the preferred embodiment, two suction side diffusion slots and two pressure side diffusion slots are used. Each diffusions slot has a width such that the two slots cover the suction side or pressure side of the leading edge to provide the necessary film cooling for the leading edge. The width and height of the diffusion slots can vary depending upon the cooling requirements for the leading edge. The embodiment of the present invention disclosed is intended to be used in industrial gas turbine engines in which the vanes and blades are rather large compared to aero gas turbine engines. The diffusion slots have an area ratio (the exit area over the inlet area of the slot passage) of from about 2 to about 5. For an exit ratio of 5, the area of the exit hole is 5 times the area of the entrance hole for the slot passage.

Figure 6:
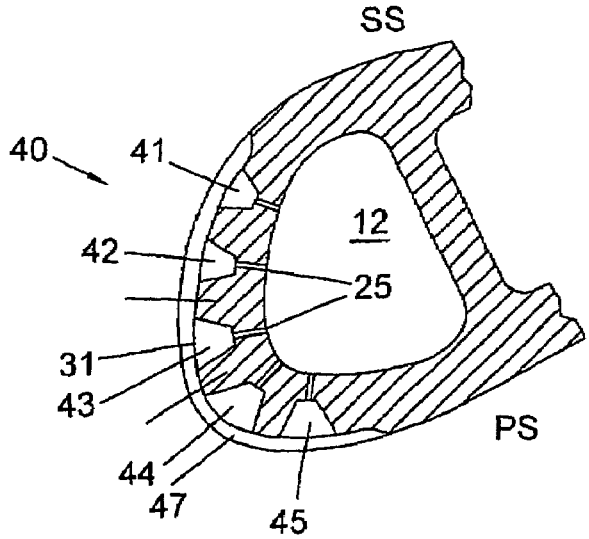
FIG. 6 shows a cross section view of a leading edge showerhead for a second embodiment of the present invention.

A second embodiment of the showerhead arrangement of the present invention is shown in FIG. 6. Instead of the four slots in the first embodiment, the second embodiment includes five slots with the middle slot positioned at the stagnation point. The stagnation point in FIG. 6 is shown as 31. The five slots are labeled as 41 through 45 in FIG. 6 with the middle slot 43 positioned at the stagnation point 31. Each slot includes a cooling supply hole 25 connected to the cooling supply channel 12. The slots 41 through 45 have the same size and configuration as described in the first embodiment. A continuous slot 47 extends from the first slot 41 to the fifth slot 45. The row of five slots also has an inverted V-shape in which the middle slot 43 can be flat or V-shaped. The slots 41 through 45 also can have an area ratio from about 2 to about 5.

A process for cooling a leading edge of a turbine airfoil includes the following steps. Metering cooling air from a cooling air supply cavity located in the leading edge portion of the airfoil; diffusing the metered cooling air into a plurality of diffusion slots located on the sides of the stagnation point; diffusing the cooling air into a continuous diffusion slot downstream from the plurality of diffusion slots; and then diffusing the cooling air into the continuous diffusing slot arranged in an inverted V shape across the leading edge of the airfoil.

I claim:

1. A turbine airfoil for a gas turbine engine, the airfoil comprising:

a cooling air supply channel located adjacent to a leading edge of the airfoil to supply pressurized cooling air to the leading edge of the airfoil;

a plurality of first diffusion slots arranged along a chordwise direction of the leading edge, the plurality of first diffusion slots being fluidly separated from each other;

a metering hole connecting the cooling air supply channel to each of the first diffusion slots; and, a continuous second diffusion slot arranged along the leading edge and connected to the plurality of first diffusion slots, the second diffusion slot extending from a suction side to a pressure side of the leading edge.

2. The turbine airfoil of claim 1, and further comprising:

the continuous diffusion slot extends past the first diffusion slots on the suction side and the pressure side of the leading edge.

3. The turbine airfoil of claim 1, and further comprising:

the continuous diffusion slot is arranged in an inverted V shape about a stagnation point on the leading edge.

4. The turbine airfoil of claim 1, and further comprising:

the plurality of first diffusion slots includes four first diffusion slots along the chordwise length of the airfoil that include two pressure side diffusion slots and two suction side diffusion slots.

5. The turbine airfoil of claim 1, and further comprising:

the plurality of first diffusion slots includes five first diffusion slots along the chordwise length of the airfoil that include two suction side slots and two pressure side slots and one stagnation point slot.

6. The turbine airfoil of claim 1, and further comprising:

the first diffusion slots have an area ratio of from about 2 to about 5.

7. The turbine airfoil of claim 1, and further comprising:

the metering holes, the first diffusion slots and the continuous diffusion slot all are angled with respect to the leading edge surface of the airfoil.

8. The turbine airfoil of claim 1, and further comprising:

the first diffusion slots and the continuous diffusion slot have about the same height.

9. The turbine airfoil of claim 1, and further comprising:

a plurality of chordwise extending metering holes, first diffusion slots and continuous diffusion slots arranged along the spanwise direction of the airfoil.

10. The turbine airfoil of claim 1, and further comprising:

the continuous diffusion slot forms a showerhead arrangement for discharging film cooling air onto the leading edge surface of the airfoil.

11. A process for cooling a leading edge of a turbine airfoil, the turbine airfoil having a pressure side and a suction side and a stagnation point separating the pressure side from the suction side, the process comprising the steps of:

metering cooling air from a cooling air supply cavity located in a leading edge portion of the airfoil;

diffusing the metered cooling air into a plurality of separate first diffusion slots located on the sides of the stagnation point; and, diffusing the cooling air from the first diffusion slots into a continuous diffusion slot to discharge film cooling air onto the leading edge of the airfoil, wherein the continuous diffusion slot extends from the suction side to the pressure side of the leading edge.

12. The process for cooling a leading edge of a turbine airfoil of claim 11, and further comprising the step of:

diffusing the cooling air into the continuous diffusing slot arranged in an inverted V shape across the leading edge of the airfoil.

* * * * *